United States Patent [19]

Caroll

[11] Patent Number: 4,977,479

[45] Date of Patent: Dec. 11, 1990

[54] STATIC ELECTRICITY ELIMINATOR IN CLOTHES DRYERS

[76] Inventor: Rick Caroll, Post Office Box 53084, Lafayette, La. 70505

[21] Appl. No.: 228,534

[22] Filed: Aug. 4, 1988

[51] Int. Cl.[5] ..... H05F 3/02

[52] U.S. Cl. ..... 361/220; 34/1; 34/133

[58] Field of Search ..... 361/212, 270, 221, 222; 34/1, 133

[56] References Cited

U.S. PATENT DOCUMENTS

| | | | |
|---|---|---|---|
| 2,568,068 | 9/1951 | Harpman | 361/222 |
| 3,161,479 | 12/1964 | Biderman | 361/212 |
| 3,991,479 | 11/1976 | Dionne | 34/1 |
| 4,107,755 | 8/1978 | Kiefer | 361/220 |
| 4,190,874 | 2/1980 | Pasold | 361/212 |
| 4,352,143 | 9/1982 | Uno | 361/221 |
| 4,402,593 | 9/1983 | Bernard et al. | 361/221 X |
| 4,618,909 | 10/1986 | Sanders | 361/212 |
| 4,631,630 | 12/1986 | Beane | 361/212 |

*Primary Examiner*—Brian W. Brown

*Attorney, Agent, or Firm*—Pravel, Gambrell, Hewitt, Kimball & Krieger

[57] ABSTRACT

A plurality of stainless steel wire sprays along the wall of the drum of the clothes dryer. Preferably, the sprays would be positioned along a straight line of the wall, and would be covered with a perforated plastic guard, so that the clothes tumbling within the drum of the clothes dryer do not make contact with the stainless steels sprays. So that the charged electrons may make contact with the stainless steel sprays and become neutralized, the guard would be equipped with a plurality of ports, to allow the flow of charges between the charged close and the stainless steel sprays. In the preferred embodiment, there would preferably be located one or more equally spaced apart rows of sprays covered with a guard, so that the entire drum would be adequately supplied with the static eliminating means. An alternate embodiment would allow the location of the stainless steel sprays either on the rear wall of the drum or on the front door of the dryer, likewise having a single guard to cover one or a group of sprays, for the same reason. In either embodiment, it is foreseen that this method of eliminating static electricity would allow a one-time positioning of this item within the drum of a dryer, and would therefore result in the elimination of static electricity from the clothes for the life of the dryer.

12 Claims, 2 Drawing Sheets

STATIC ELECTRICITY ELIMINATOR IN CLOTHES DRYERS

BACKGROUND OF THE INVENTION

1. Field of the Invention

The apparatus of the present invention relates to static electricity. More particularly, the present invention relates to a system for removing or reducing the static electricity or "static Cling" in clothes as a result of drying the clothes in an automatic clothes dryer.

2. General Background

In clothes dryers, of the type wherein heat is injected into a drum while the clothes are being tumbled, one of the more prevalent problems in this method of drying clothes is the presence of static electricity in the clothes which results from the process. For example, polyester garments, such as socks, sweaters, or the like, adhere to one another, and it is often difficult to locate certain smaller items of clothes that have been attached to other garments through static electricity, causing them to cling together.

At present, there are products out on the market, which attempt to remove static electricity in clothes after they have been dried. More common, are the type wherein a piece of material is added to the clothes that are being dried, which attempts to remove the static electricity from the clothes. This product is sold commercially. However, one of the shortcomings is that each load must be equipped with a new piece of material, and often times the results are less than successful.

Therefore, what is needed is a system for eliminating static electricity in clothes while they are being dried, so that when the clothes are removed from the dryer, there is no static electricity in the clothes.

SUMMARY OF THE PRESENT INVENTION

The apparatus of the present invention solves the problems in eliminating static electricity from most clothes in an automatic clothes dryer in a simple and straightforward manner. What is provided is the positioning of a plurality of conductive material, preferably stainless steel wire sprays along the wall of the drum of the clothes dryer. Preferably, the sprays would be positioned along a straight line of the wall, and would be covered with a perforated metal or plastic guard, so that the clothes tumbling within the drum of the clothes dryer do not make contact with the stainless steels sprays. So that the charged electrons may make contact with the stainless steel sprays and become neutralized, the guard would be equipped with a plurality of ports, to allow the flow of charges between the charged clothes and the stainless steel sprays. In the preferred embodiment, there would preferably be located one or more row or rows of sprays covered with a guard, so that the entire drum would be adequately supplied with the static eliminating means.

An alternate embodiment would allow the location of the stainless steel sprays either on the rear wall of the drum or on the front door of the dryer, likewise having a single guard over a single or group of sprays, for the same reason. In either embodiment, it is foreseen that this method of eliminating static electricity would allow a one-time positioning of this item within the drum of a dryer, and would therefore result in the elimination of static electricity from the clothes for the life of the dryer.

Therefore, it is a principal object of the present invention to provide a system for eliminating static electricity from clothes in an automatic clothes dryer;

It is still a further object of the present invention to provide a system for eliminating static electricity from clothes which is placed within the drum of the dryer on a permanent basis; and It is still a further object of the present invention to provide a method of eliminating static electricity from clothes which does not require the addition of objects into the drum of the dryer for each load of clothes which is dried.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
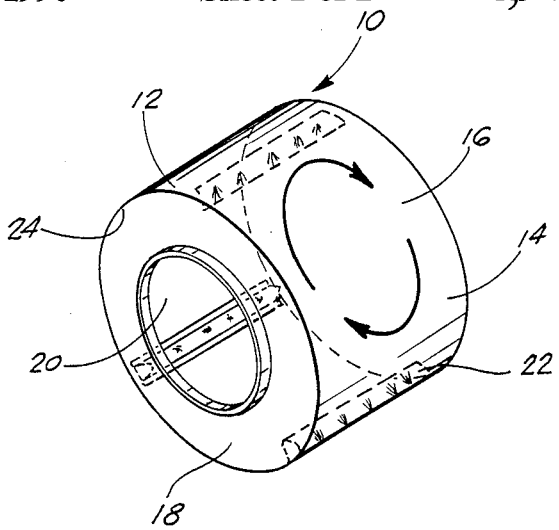
FIG. 1 illustrates an overall perspective view of the invention positioned within the drum of the dryer.
Figure 3:
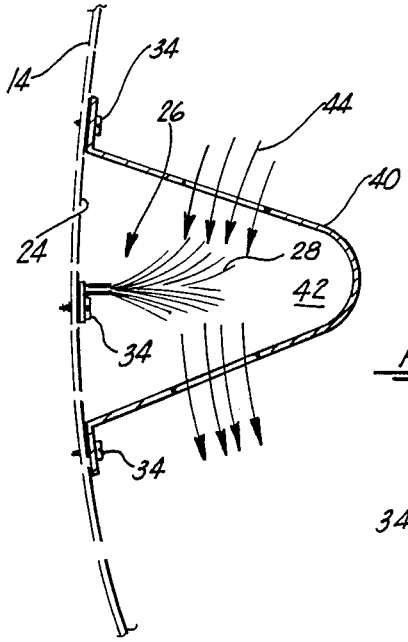
FIG. 3 illustrates a cross-sectional view of the present invention mounted on the inner surface of the wall of the drum of the dryer.
Figure 4:
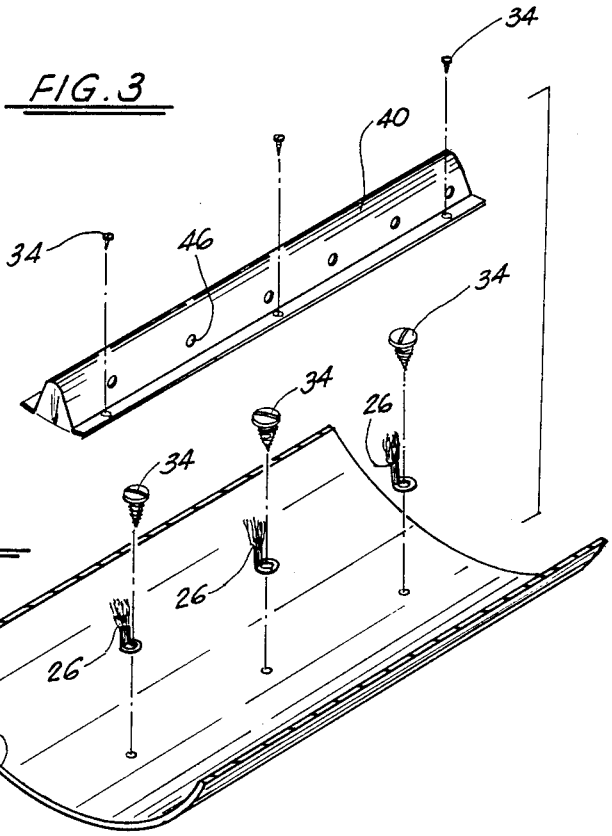
FIG. 4 illustrates an exploded view of the preferred embodiment o system of the present invention.
Figure 5A:
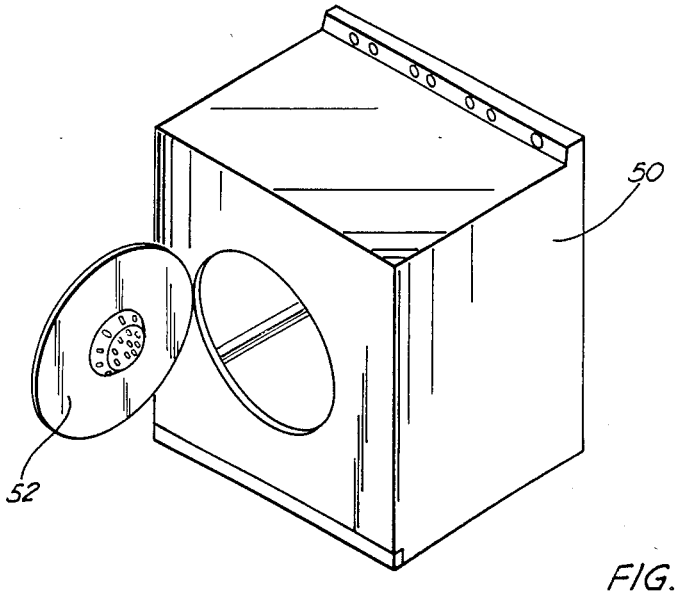
FIGS. 5A, 5B, and 5C represent an additional embodiment of present invention.
Figure 5B:
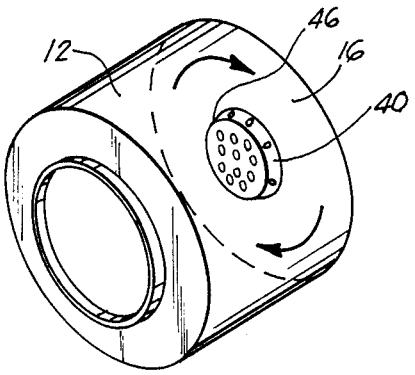
Figure 5C:
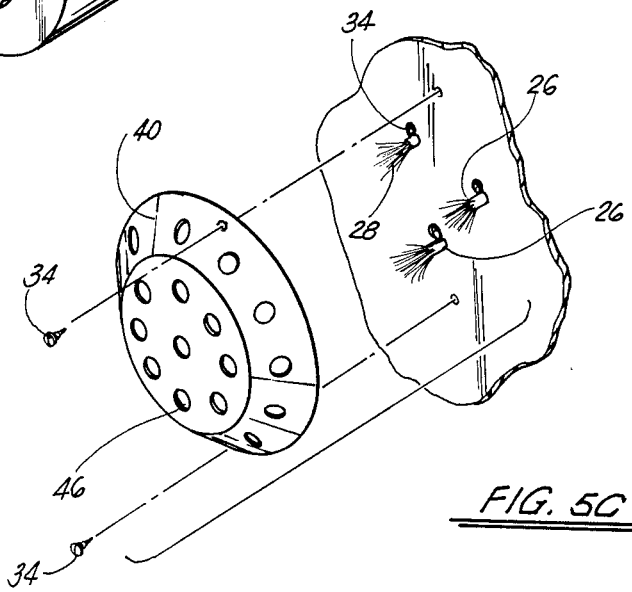

FIGS. 1 through 4 illustrate the preferred embodiment of the system of the present invention, with FIGS. 5A through 5C representing an alternate embodiment. As seen in FIG. 1, the apparatus of the present invention is illustrated by the numeral 10 positioned within a dryer drum 12. For purposes of construction, a typical drum used in an automatic clothes dryer would include a continuous circular side wall 14 with a back wall 16 and a front wall 18, with the front wall 18 having a loading port 20 wherein clothes would be placed into the drum through the loading port 20, and a door 52 (such as seen in FIG. 5A) would be closed against the port, so that when drum 12 is rotated, the clothes are maintained within the drum. In normal cases, either through gas or electrically generated heat, hot air is blown into the drum during the drying, so that the clothes within the drum are dried as they are tumbled throughout the drum. In addition, as seen in FIG. 1, there are provided a plurality of transverse members 22 attached to the inner wall 24 of drum 12, which have been modified for the present invention. However, in standard operation each of these members 22 would serve to ensure that the clothes are tumbled while the drum is rotating rather than lying flat along the wall of the drum.

Figure 2:
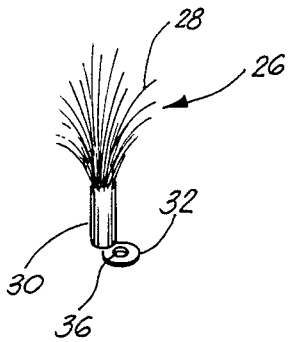
FIG. 2 illustrates an isolated view of a single steel spray of the present invention.

Turning now to the system of the present invention, there is provided as seen in FIG. 2, a means for attracting charge particles such as electrons which are developed through the contact of clothes within the dryer, and result in the formation of static electricity within the drum as the clothes are dried. This means would include a conductive material spray, preferably a stainless steel wire spray 26 which would include a great plurality of fine stainless steel wires 28 bundled at their base in a mount 30, and allow to flair into the spray 26 as seen in FIG. 2. The base 30 would include a mounting ring 32, so that the spray 26 may be mounted onto the inner surface 24 of the wall 14 of drum 12 as seen in FIG. 2. This mounting may be accomplished via a metal screw 34 inserted through the port 36 in base 32 and screwed into the wall 14 of drum 12. As seen in FIGS. 1 and 3, the mounting of such a spray 26 would be done in a fashion wherein a plurality of sprays 26, preferably 3 to 5 would be mounted along a straight line transverse to the circular rotation of the drum. Of course, each of the sprays would be mounted via a screw 34 as seen in FIGS. 1 and 4. Following the mounting of the sprays 26 via screws 34, a guard 40 is positioned upon the row of sprays 26, yet without making contact with the sprays 26, as seen in side view in FIG. 3. Therefore, there is provided a space 42 between the steel members 28 and the wall of the guard 40, so that a flow of air carrying charged electrons in the direction of Arrows 44, for example, may flow through a plurality of ports 46 in the wall of guard 40. In theory, the charged particles flowing through the guard 40, would make contact with the members 28 of spray 26, and be neutralized and therefore eliminating the charged particles or the "static electricity" in the drum.

As seen in FIG. 1, such a positioning of a row of sprays 26 along the wall 14 of drum 12 would be done preferably at one or more equally spaced apart locations along the inner surface 24 of wall 14, so that the positioning of the sprays would be equally divided along the wall of the drum. As seen in FIG. 3, the shaped of each guard 40 is such, that the guard 40 in addition to serving as the guard for eliminating contact between the clothes in the drum and the sprays 26 also functions as the transverse member presently found in dryer drums in order to keep the clothes tumbling rather than lying flat along the wall of the drum. As with the sprays 26, each guard 40 likewise would be attached to the wall 14 via a plurality of metal screws 34 as seen in FIGS. 3 and 4.

Turning now to FIGS. 5A through 5C, there is seen an additional embodiment of the system of the present invention. The system in FIGS. 5A through 5C would be operated under the same theory of operation. That is a plurality of sprays 26 would be positioned within the drum 12 of a dryer 50, with each spray 26 likewise mounted with a metal screw 34 to the wall of the drum and a guard 40 placed thereupon. However, in the particular embodiment as seen in FIG. 5A, rather than have a series of transverse rows of sprays along the inner wall of the drum 12, in FIG. 5A there is illustrated a single or patch of sprays (as seen in FIG. 5C), wherein one or more sprays would be clustered, for example in FIG. 5A, on the front door 52 of dryer 50, and a flat guard 40, being of a single truncated shape, would be placed on the sprays. This guard likewise would be mounted with a plurality of metal screws 34, and as with the guard 40 as seen in FIG. 3, would also have a plurality of ports 46 for the flow of charts air through the guard to make contact with the individual elements 28 of each spray 26. The only difference between this embodiment and the principal embodiment is the fact that there is a single guard mounted over a cluster of sprays 26 on the front door of the dryer rather than on a transverse rows as discussed and seen in FIG. 1.

FIG. 5B represents yet another place to position the guard 40 as seen in FIG. 5C. Rather than being placed on the door 52 as seen in FIG. 5A, the single cluster of sprays 26 may be placed on the rear wall 16 of the drum 12, with the guard 40 again being mounted via a plurality of metal screws 34 onto the wall to cover the sprays 26. Likewise, guard 40 has a plurality of ports 46 for allowing the flow of charged air therethrough.

In either embodiment, the elements 28 of spray 26 must be of a metallic nature such as stainless steel, and the guard in the preferred embodiment is made of a plastic material. It is imperative, however, that each of the guards have a plurality of ports through the wall of the guards so that the charged air may make contact with the sprays 26 in eliminating the charges in the air.

Although it is foreseen that stainless steel would be the preferable material for the metallic clusters, any conductive material would be suitable. Although the clusters would present a large number of disipater points, there may be other methods of capturing the electrons, perhaps with the use of a single wire as well as a plurality of wires as noted.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. Apparatus for eliminating static electricity in a clothes dryer having an inner space in which clothes are dried, the inner space being bounded by an inner surface of the dryer, the apparatus comprising:

(a) a plurality of sprays, each spray comprising a plurality of strands of conductive material;

(b) attachment means for attaching the sprays to said inner surface of the dryer; and (c) guard means for preventing physical contact between the sprays and the clothes being dried in the dryer but allowing electrical contact between the air in the inner space and the sprays.

2. The apparatus of claim 1, wherein the guard means comprises tumbling vanes having holes therein.

3. The apparatus of claim 2, wherein the conductive material is metal wire.

4. The apparatus of claim 3, wherein the metal wire is stainless steel wire.

5. The apparatus of claim 1, wherein the attachment means comprises:

a collar surrounding a first end of the plurality of strands; and a ring attached to the collar.

6. The apparatus of claim 5, wherein the conductive material is metal wire.

7. The apparatus of claim 6, wherein the metal wire is stainless steel wire.

8. The apparatus of claim 1, wherein the conductive material is metal wire.

9. Apparatus for eliminating static electricity in a clothes dryer having an inner space in which clothes are dried, the inner space being bounded by an inner surface of the dryer, the apparatus comprising:

(a) a spray comprising a plurality of strands of conductive material;

(b) securing means for securing the spray adjacent said inner surface of the dryer; and (c) guard means for preventing physical contact between the spray and the clothes being dried in the dryer but allowing electrical contact between the air in the inner space and the spray.

10. The apparatus of claim 9, wherein the guard means comprises a tumbling vane having holes therein.

11. The apparatus of claim 10, wherein the conductive material is metal wire.

12. The apparatus of claim 11, wherein the metal wire is stainless steel wire.

* * * * *